US007414605B2

(12) United States Patent
Kobayashi et al.

(10) Patent No.: US 7,414,605 B2
(45) Date of Patent: Aug. 19, 2008

(54) IMAGE DISPLAY PANEL AND IMAGE DISPLAY DEVICE

(75) Inventors: Hiroshi Kobayashi, Kanagawa (JP); Junichi Yamashita, Tokyo (JP); Tamaki Harano, Tokyo (JP)

(73) Assignee: Sony Corporation (JP)

( * ) Notice: Subject to any disclaimer, the term of this patent is extended or adjusted under 35 U.S.C. 154(b) by 583 days.

(21) Appl. No.: 10/755,439

(22) Filed: Jan. 13, 2004

(65) Prior Publication Data

US 2004/0222981 A1 Nov. 11, 2004

(30) Foreign Application Priority Data

Jan. 23, 2003 (JP) ..... P2003-014308

(51) Int. Cl.
*G09G 3/36* (2006.01)

(52) U.S. Cl. ..... 345/98; 345/93; 345/94; 345/204; 345/208

(58) Field of Classification Search ..... 345/87–101, 345/204–215, 690–699
See application file for complete search history.

(56) References Cited

U.S. PATENT DOCUMENTS 6,378,080 B1 * 4/2002 Anjo et al. ..... 713/500
6,414,668 B1 * 7/2002 Karube et al. ..... 345/98
6,774,969 B2 * 8/2004 Ma et al. ..... 349/139
6,900,120 B2 * 5/2005 Ma et al. ..... 438/627
2002/0050964 A1 * 5/2002 Karube et al. ..... 345/87
2003/0077848 A1 * 4/2003 Ma et al. ..... 438/30
2004/0222981 A1 * 11/2004 Kobayashi et al. ..... 345/204
2004/0252267 A1 * 12/2004 Ma et al. ..... 349/139
2005/0017268 A1 * 1/2005 Tsukamoto et al. ..... 257/200

* cited by examiner

*Primary Examiner*—Vijay Shankar
(74) *Attorney, Agent, or Firm*—Rader Fishman & Grauer PLLC; Ronald P. Kananen

(57) ABSTRACT

To prevent a vertical stripe pattern on a display screen of an image display device and an image display panel of narrow pulse driving, there is provided an image display panel and image display device comprising a pixel portion arranged with pixels in matrix, a drive circuit connected respectively to each data line shared by pixels in each column of the pixel portion for controlling supplying of a video signal to be input to the data line based on a plurality of clocks to be input, a plurality of input pads for inputting a plurality of clocks, and a clock input circuit, wherein resistance of wiring from the plurality of input pads to the clock input circuits is made to be approximately the same between the plurality of clocks.

19 Claims, 13 Drawing Sheets

1A: IMAGE DISPLAY PANEL
2: PIXEL PORTION
3: VERTICAL DRIVE CIRCUIT
4: HORIZONTAL DRIVE CIRCUIT
6: CLOCK GENERATION PORTION } CLOCK INPUT CIRCUIT
7: CLOCK BUFFER CIRCUIT } CLOCK INPUT CIRCUIT

1B : IMAGE DISPLAY PANEL
2 : PIXEL PORTION
3 : VERTICAL DRIVE CIRCUIT
4 : HORIZONTAL DRIVE CIRCUIT
7 : CLOCK BUFFER CIRCUIT
(CLOCK INPUT CIRCUIT)

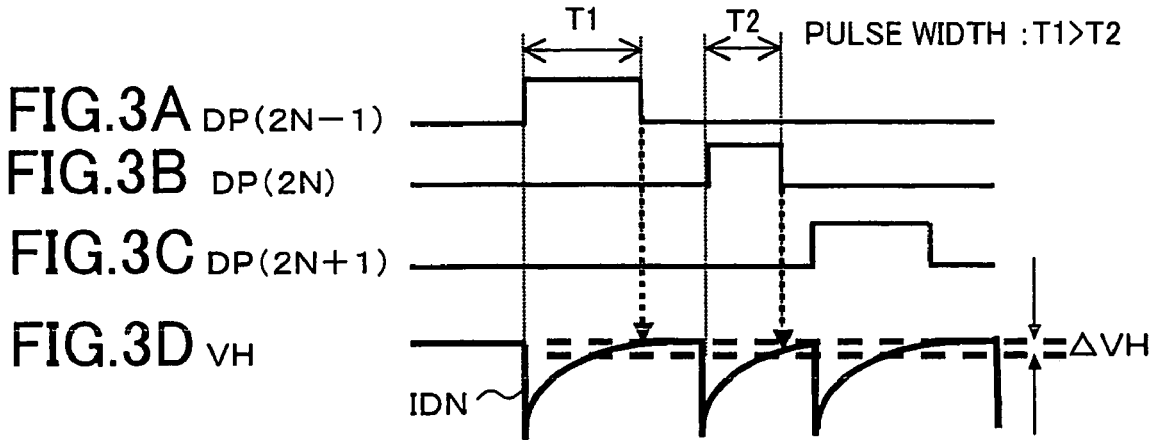
FIG.3E
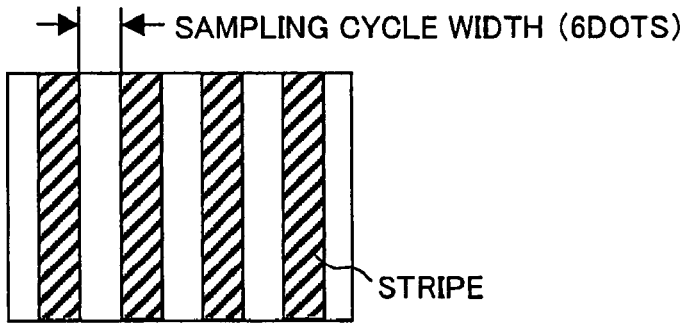

2 : PIXEL PORTION
23 : SAMPLING SWITCH GROUP
26 : VIDEO SIGNAL DRIVE CIRCUIT

FIG.6A HST
FIG.6B HCK
FIG.6C HCKX
FIG.6D DCK1
FIG.6E DCK2
FIG.6F CP1
FIG.6G CP2
FIG.6H CP3
FIG.6I DP1
(DPodd)
FIG.6J DP2
(DPeven)
FIG.6K DP3
(DPodd)

FIG.11A DPodd
FIG.11B DPeven

T
T
SP
Sig12
Sig11
Sig2
Sig1
HSW
12DOTS
12DOTS
2 PIXEL PORTION

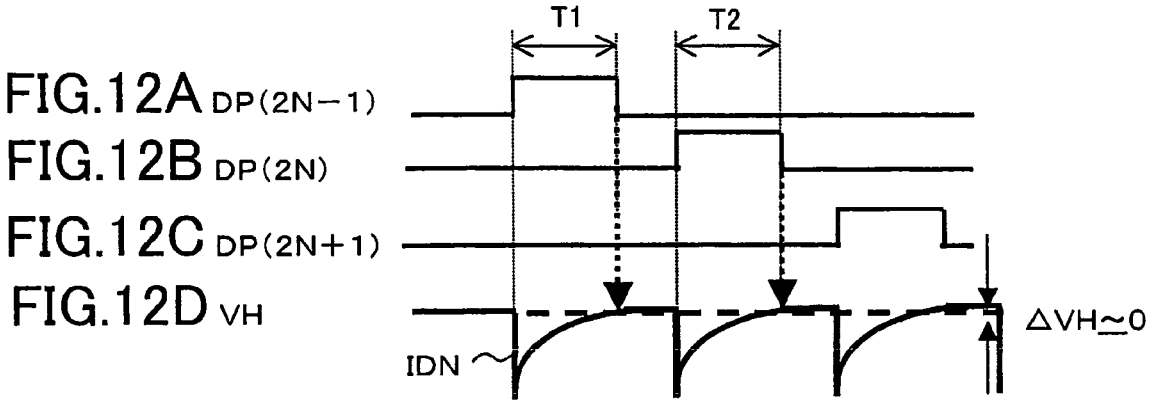
FIG.12E
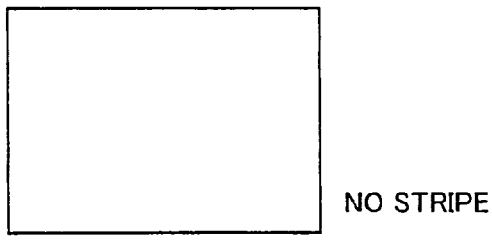

FIG. 13
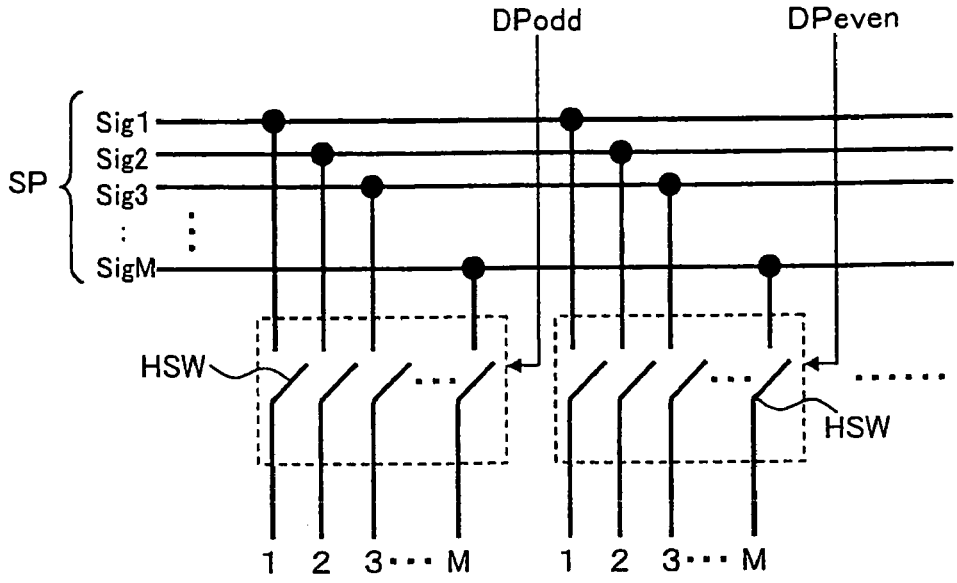
PRIOR ART
PRIOR ART
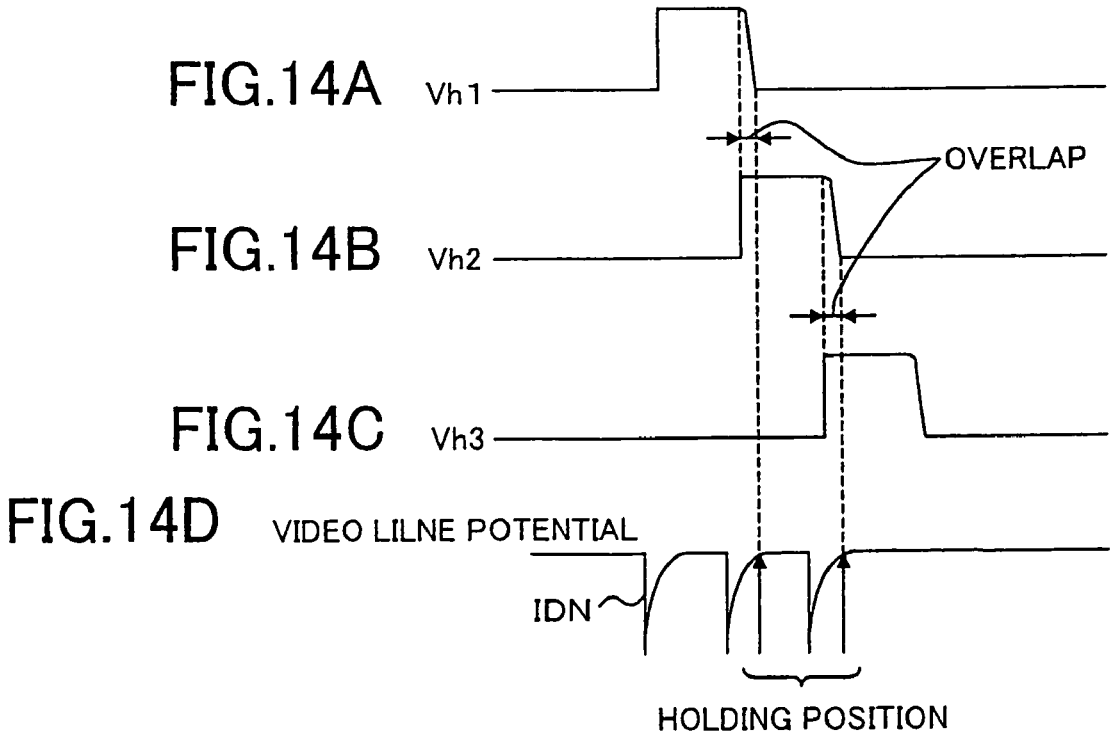

PRIOR ART
FIG.15A
FIG.15B
FIG.15C
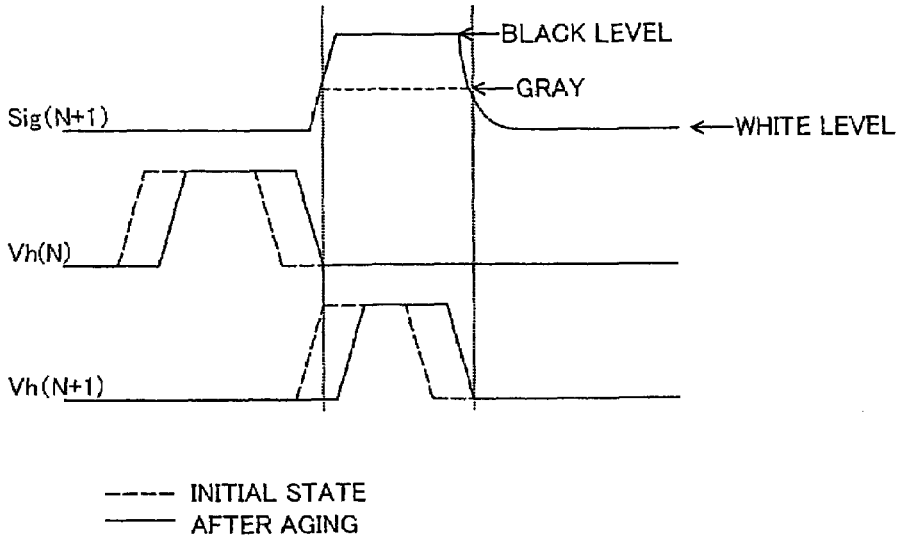
FIG.15D
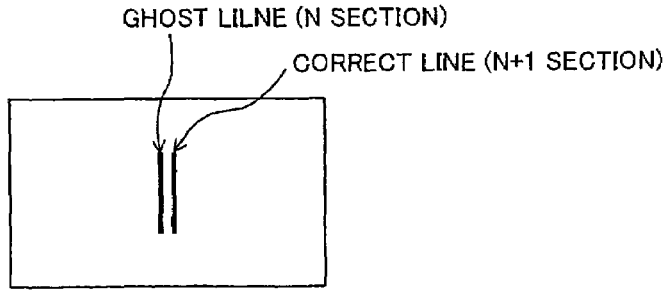

IMAGE DISPLAY PANEL AND IMAGE DISPLAY DEVICE

BACKGROUND OF THE INVENTION

1. Field of the Invention

The present invention relates to an image display device and image display panel wherein a so-called point sequential clock driving system is applied in a drive circuit.

2. Description of the Related Art

FIG. 1 and FIG. 2 are block diagrams of an example of the configuration of an image display panel wherein the point sequential clock driving system is applied.

Image display panels 1A and 1B comprise, as shown in FIG. 1 and FIG. 2, a pixel portion 2 arranged with pixels in matrix, and a vertical drive circuit (V.DRV) 3, a horizontal drive circuit (H.DRV) 4 and a precharge circuit (P.CHG) 5 as a variety of circuits connected to the pixel portion 2.

The pixel portion 2 uses, for example, a liquid crystal cell as a display element (pixel) of an image. Each liquid crystal cell is provided with a liquid crystal element and a Thin Film Transistor (TFT) which is turned on when displaying for supplying a video signal SP to one electrode (pixel electrode) of the liquid crystal element. While not particularly shown, gates of the TFT on each row (one display line) are connected to a gate line and either one of sources and drains of the TFT on each column are connected to a data line. The vertical drive circuit (V.DRV) 3 scans (sequentially drives every predetermined time),gate lines when displaying an image, and the horizontal drive circuit (H.DRV) 4 point-sequentially supplies display data of an amount of one display line to the data line (horizontal scan) in a driving time of the gate line (horizontal scan period). By combining the horizontal scan and the vertical scan, an image of one screen is displayed on the pixel portion 2.

In the point sequential clock driving system, the horizontal drive is controlled by a horizontal clock.

In the configuration example shown in FIG. 1, a clock generation portion 6 inside the panel generates horizontal clocks (hereinafter, referred to as drive clocks) DCK1 and DCK2 having a pulse width of a smaller duty ratio and reversed phases to each other and their inverted drive clocks DCK1X and DCK2X based on horizontal clocks HCK and HCKX having reversed phases to each other input from outside. When the horizontal drive circuit (H.DRV) 4 receives a horizontal start pulse (HST: not shown) from the outside or the clock generation portion 6, it shifts the horizontal start pulse (HST) by a built-in shift register driven by input horizontal clocks HCK and HCKX having reversed phases to each other, extracts drive clocks DCK1 and DCK2 based on the shifted pulse and generates a drive pulse for driving a data sampling switch (HSW). The data sampling switch (HSW) is, while not particularly illustrated, provided to an output stage of the horizontal drive circuit (H.DRV) 4 or a video signal input portion of the pixel portion 2 and samples point-sequentially an input video signal by the horizontal drive pulse. Note that, in FIG. 1, a clock buffer circuit 7 is provided in accordance with need. In this case, the clock buffer circuit 7 adjusts the horizontal clock HCK by using the horizontal clock HCKX, adjusts the drive clock DCK1 by using the drive clock DCK1X, adjusts the drive clock DCK2 by using the drive clock DCK2X and outputs the adjusted drive clocks DCK1 and DCK2. Also, the clock buffer circuit 7 converts a voltage level of various clocks to a voltage suitable to panel driving.

On the other hand, in the configuration example shown in FIG. 2, the horizontal clock HCK and its inverted clock HCKX, drive clocks DCK1 and DCK2 and their inverted drive clocks DCK1X and DCK2X for driving the horizontal drive circuit (H.DRV) 4 are all given from outside of the panel.

Note that a start pulse and a clock for driving the vertical drive circuit (V.DRV) 3 are omitted in FIG. 2. Also in this case, a clock buffer circuit 7 having the same function as that in FIG. 1 is provided in accordance with need.

In an image display device of the point sequential driving system, in the case where one-channel video signal SP is input, it becomes difficult to secure a sufficient sampling time for successively sampling all pixels in a limited horizontal scan period (1H period) particularly when the number of pixels in the horizontal direction increases as the definition gets higher.

Thus, to secure a sufficient sampling time for one pixel, as shown in FIG. 13, there is known an M-phase driving system of inputting M-channel video signals SP (M is an integer of two or more) in parallel and, in unit of M-number of sampling switches corresponding to M-number of pixels in the horizontal direction, driving M-number of sampling switches HSW in one unit by one sampling pulse DPodd or DPeven at a time so as to perform successive writing in unit of M pixels.

Here, a pixel display unit configured by a group of pixels connected to M-number of data lines (normally an even number, for example, 6 or 12) in the horizontal direction, to which a video signal is supplied at a time will be referred to as a "section" below.

In the above horizontal driving method of pixels, the drive pulses DPodd and DPeven as data sampling pulses are generated by extracting pulses from the drive clocks DCK1 and DCK2 having reversed phases to each other and a smaller duty ratio than that of the horizontal clocks HCK and HCKX. In the case of driving the drive clocks having reversed phases to each other, one of a section of an odd number, that is, (2N−1) (N is a natural number) and a section of an even number, that is, 2N is driven by a drive pulse extracted from the drive clock DCK1 and the other is driven by a drive pulse extracted from the drive clock DCK2. In FIG. 13, the drive pulse driving the odd section is indicated by DPodd and the drive pulse driving the even section is indicated as DPeven.

The reason of using the drive clocks DCK1 and DCK2 having reversed phases to each other is because the sampling number of two times per one clock cycle is possible, so that a sampling frequency can be doubled from a horizontal driving frequency.

Also, the reason of making the duty ratio of the drive clocks DCK1 and DCK2 small is to secure a margin for a ghost on the display screen caused by an overlap of sampling pulses and phase deviation (drift) of pulses and to prevent deterioration of image quality caused thereby. Below, the causes of deteriorating image quality will be explained.

FIG. 14A to FIG. 14D are signal waveforms in the case pulses extracted not from the drive pulses but from the horizontal clocks HCK and HCKX are used for data sampling.

Since more or less roundness is generated in the clock pulse shape due to resistance of wiring and a parasitic capacitance from generation of the horizontal clocks HCK and HCKX to extraction of pulses, a tailing shape arises more or less in the extracted pulses Vh1 to Vh3 as shown in FIG. 14A to FIG. 14C. As a result, the waveforms overlap between the sampling pulses Vh1 and Vh2 and between sampling pulses Vh2 and Vh3.

Generally, at a moment of turning on the horizontal sampling switch HSW, induced noise IDN is more or less generated on a video line as shown in FIG. 14D via a connection capacitance due to relationship of potentials of the video line to be supplied a video signal and a data line.

Under such a circumstance, when sampling pulses Vh1 and Vh2 or Vh2 and Vh3 are overlapped as explained above, induced noise IND generated by turning on the sampling switch HSW of the next section overlaps with the sampling period and unfavorably holds it. As a result, the holding potential, that is, a potential of pixel data after sampling becomes uneven and deteriorates the image quality.

An active element of variety of circuits incorporated in the panel is composed of a TFT formed on the same substrate as the TFT of the pixel portion 2. The TFT has larger characteristic variation comparing with a bulk transistor and the characteristic is easily changed by aging and other heat treatment. When characteristic of the TFT changes, particularly a sampling timing by the data sampling switch HSW is deviated. The deviation of the sample timing causes a phenomenon called "ghost", that is, an undesirable image generated by deviating by certain dots from a correct image position overlaps with the correct image on the display screen.

FIG. 15A to FIG. 15C are timing charts of a signal when ghost arises, and FIG. 15D shows the display screen.

A video signal Sig(N+1) in the (N+1) section among a video signal divided to M sections is shown in FIG. 15A. Normally, a pulse of a video signal deforms more or less, such as a tailing shape, due to affection by delay. A sampling pulse Vh(N+1) of the deformed video signal is shown in FIG. 15C, and a sampling pulse Nh(N) in the N section, which is one section before, is shown in FIG. 15B. In FIG. 15B and FIG. 15C, a broken line indicates a pulse in an initial state and a solid line indicates a pulse after drifting by aging, etc. When assuming that the video signal is sampled at rising of a sampling pulse and held at falling, the video signal Sig(N+1) in the (N+1) section is sampled and held in both of the N section and (N+1) section by the drift of the pulse and, furthermore, appears on the display screen at a level of an intermediate gradation color (gray).

Here, the ghost margin is generally a distance between a focused section and a section of a pulse affecting as a ghost thereof and expressed by the number of sections between the two. In an example in FIG. 15, the ghost arises in the adjacent section, so that the ghost margin is 0 (unit is section).

By generating the sampling pulse by extracting a pulse not from the horizontal clock itself but from a drive clock having a smaller duty ratio generated from the horizontal clock, the overlap of pulse waveforms and the margin to ghost explained above can be increased without raising the horizontal drive frequency. The image display panel shown in FIG. 1 and FIG. 2 realizes highly fine image expression by a technique of using four clocks HCK, HCKX, DCK1 and DCK2 and supplying, for example, a 6-phase or 12-phase video signal.

Along with an increase of kinds of image display panels and a reduction in costs, a cost reduction by commonality of components becomes necessary.

For example, to perform M-phase driving on a video signal, a sample hold IC used in common has been developed, wherein M-number of (for example 6) sample hold circuits are incorporated, the input video signal SP is divided to M-number of outputs at a timing controlled by a timing control signal of the horizontal drive circuit, and M-number of signals Sig1 to SigM are output at a time at a timing when the M-number of outputs are all prepared. Further in detail, a method wherein an Extended Graphics Array (XGA) display standard panel conventionally driven by 12-dot simultaneous sampling is driven by 6-dot simultaneous sampling in the same way as in the Super Video Graphics Array (SVGA) display standard panel has been developed. Due to this, the sample hold IC required two for each of RGB in 12-dot simultaneous sampling is required one for each by performing 6-dot simultaneous sampling, that is, the number is halved and the cost is reduced for that amount.

When realizing a panel having horizontal pixels of K times (K is an integer of 2 or more) as much as that of a panel conventionally used by the circuit by using a video signal drive circuit for M-number simultaneous sampling, a width of the sampling pulse has to be simply 1/K to be used. Namely, in the above example, to realize horizontal driving of an XGA panel by using one SVGA sample hold IC capable of performing 6-dot simultaneous sampling, widths of the drive pulses DPodd and DPeven have to be ½.

To realize the above non-overlap sampling and ghost margin securement under this constraint, the drive pulse in the above example becomes a narrow pulse having a width of, for example, 30 to 45 nsec or so. This pulse width is remarkably narrow comparing with a drive pulse width of 150 nsec in the conventional XGA panel realizing 12-dot simultaneous sampling by using two sample hold ICs. Below, the panel driving using a pulse having a width of 50 nsec or less as such will be referred to as "narrow pulse driving".

In an XGA panel driven by the narrow pulse driving, there arose a phenomenon that a vertical stripe pattern of every sampling dot number of the sample hold IC, that is, every 6 dots appeared on the display screen. This phenomenon has been observed conventionally, which has been known to be caused by a characteristic difference of two sampling hold ICs. However, it is obvious that it is not caused by the characteristic difference of the ICs because the sample hold IC is provided one here.

SUMMARY OF THE INVENTION

An object of the present invention is to provide an image display device and the image display panel of narrow pulse driving capable of preventing a vertical stripe pattern on a display screen thereof.

The present inventors analyzed causes of the phenomenon that a vertical stripe pattern of every 6 dots appears on the display screen explained above, as a result, found that pulse widths were slightly different between a drive pulse DPodd for determining a sampling time when supplying a video signal to odd sections of the panel and a drive pulse DPeven for determining a sampling time when supplying a video signal to even sections. The drive pulses DPodd and DPeven are generated by extracting pulses from drive clocks, and the drive clocks are generated by circuits having symmetrical layout and elements in a clock generation circuit 6 or a clock buffer circuit 7. Also, inside the drive circuit 4 has a wiring layout formed symmetrically as much as possible. The present inventors found out that the slight difference of the pulse widths is generated during propagation on wiring from an input of the drive clocks to the panel to the first circuit.

The present invention has made based on the above analysis and has characteristics below.

According to a first aspect of the present invention, there is provided an image display panel, comprising a pixel portion arranged with pixels in matrix; a drive circuit connected to each data line shared by the pixels in each column of the pixel portion for controlling supplying of a video signal to be input to the data line based on a plurality of clocks to be input; a plurality of input pads for inputting the plurality of clocks; and a clock input circuit connected between the input pads and the drive circuit, wherein resistance of wiring from the plurality of input pads to the clock input circuit is set approximately the same between a plurality of clocks.

According to a second aspect of the present invention, there is provided an image display panel, comprising a pixel portion arranged with pixels in matrix; a drive circuit connected to each data line shared by the pixels in each column of the pixel portion for controlling supplying of a video signal to be input to the data line; and a plurality of input pads for inputting a plurality of clocks for driving the drive circuit, wherein resistance of wiring from the plurality of input pads to the drive circuit is set approximately the same between a plurality of clocks.

According to the first aspect of the present invention, there is provided an image display device, comprising an image display panel having a pixel portion arranged with pixels in matrix, a drive circuit connected to each data line shared by the pixels in each column of the pixel portion for controlling supplying of a video signal to be input to the data line, and a clock input circuit for receiving as an input a plurality of clocks for driving the drive circuit and outputting to the drive circuit; and a clock generation circuit for generating the plurality of clocks, wherein resistance of wiring from an output of the clock generation circuit outside the image display panel to the clock input circuit inside the image display panel is set to be approximately the same between a plurality of clocks.

According to the second aspect of the present invention, there is provided an image display device, comprising an image display panel having a pixel portion arranged with pixels in matrix, a drive circuit connected to each data line shared by the pixels in each column of the pixel portion for controlling supplying of a video signal to be input to the data line; and a clock generation circuit for generating the plurality of clocks, wherein resistance of wiring from an output of the clock generation circuit outside the image display panel to the drive circuit inside the image display panel is set to be approximately the same between a plurality of clocks.

In the image display panel of the present invention, a plurality of clocks are input via input pads from outside of the panel to a clock input circuit or a drive circuit. In the present invention, since resistance of wiring is set to be approximately same from the input pads to which the plurality of clocks are input to the clock generation circuit or the drive circuit, phases of the clocks when input to the drive circuit become approximately same as a value expected at the time of designing. Since the drive circuit is driven by using the plurality of clocks with no delay, a timing that an input video signal is supplied to a data line becomes approximately the same as a timing expected at the time of designing. Therefore, even when the sampling time is short, data of the video signal after being supplied to the data line approximately matches with data immediately before the sampling. Furthermore, a part of data is not erroneously sampled and supplied to the adjacent data line.

In the image display device of the present invention, when a clock generation circuit is provided outside the panel, resistance of wiring from the clock circuit to the first circuit inside the panel (a clock input circuit or a drive circuit) is set to be approximately the same between a plurality of clocks, so that data of the video signal is supplied to the corresponding data line without being erroneously sampled.

BRIEF DESCRIPTION OF DRAWINGS

These and other objects and features of the present invention will become clearer from the following description of the preferred embodiments given with reference to the attached drawings, in which:

FIG. 3A to FIG. 3C are views of waveforms of a drive pulse in three consecutive sections when the present invention is not applied, FIG. 3D is a schematic view of a holding potential in a supply line of the video signal, and FIG. 3E is an explanatory view of a vertical stripe (broad line) on the display screen;

FIG. 11A and FIG. 11B are waveforms of drive pulses in a 12-phase driving XGA panel of the related art.

FIG. 12A to FIG. 12C are views of waveforms of a drive pulse in three consecutive sections when the present invention is applied, FIG. 12D is a schematic view of a holding potential in a supply line of the video signal, and FIG. 12E is a view of the display screen;

FIG. 13 is an explanatory view of an M-phase driving system;

FIG. 14A to FIG. 14C are views of waveforms of pulses when an overlap arises between the pulses, FIG. 14D is a schematic view of a potential of a video line at that time; and FIG. 15A to FIG. 15C are timing charts of a signal when a ghost arises, and FIG. 15D is a view of the display screen at that time.

DESCRIPTION OF THE PREFERRED EMBODIMENT

First, a cause of a phenomenon that a difference of pulse widths of a drive pulse DPoff in an odd section and a drive pulse DPeven in an even section appears as a vertical stripe clarified by the above analysis will be explained.

FIGS. 3A and FIG. 3B are views of waveforms of drive pulses in an odd (2N−1) section, an even (2N) section and an odd (2N+1) section next to it. Also, FIG. 3D is a schematic view of a holding potential in a supply line of a video signal, and FIG. 3E is an explanatory view of a vertical stripe (broad lines) on the display screen.

As explained above, induced noise IDN is superposed on a supply line of a video signal every time the drive pulse rises, and a potential is changed due to the noise and returns to an original potential level in a time in accordance with values of resistance of wiring and parasitic capacitance. Here, a drive pulse width T1 in the odd section is assumed to be larger than the drive pulse width T2 in the even section. When the pulse widths are relatively long, such as 150 nsec, a holding potential VH regulated by falling of the drive pulse is not affected by the induced noise IDN. However, when the pulse widths become short as 50 nsec or less, as shown in FIG. 3D, a process that the sampling potential returns to the original potential level superposes on a rising timing of the drive pulse. Therefore, a delicate difference ΔVH arises in the holding potential VH due to the difference of the pulse widths. Even if the potential difference ΔVH is small, offset arises in a base potential of a pixel signal of every 6 dots in 6-dot simultaneous sampling, moreover, this is repeated to be a vertical stripe pattern allover the screen, so that it is recognized as the broad lines as shown in FIG. 3E.

The present embodiment is to prevent the broad lines and will be explained in detail by taking as an example an active matrix type liquid crystal display panel with reference to drawings below.

Figure 1:
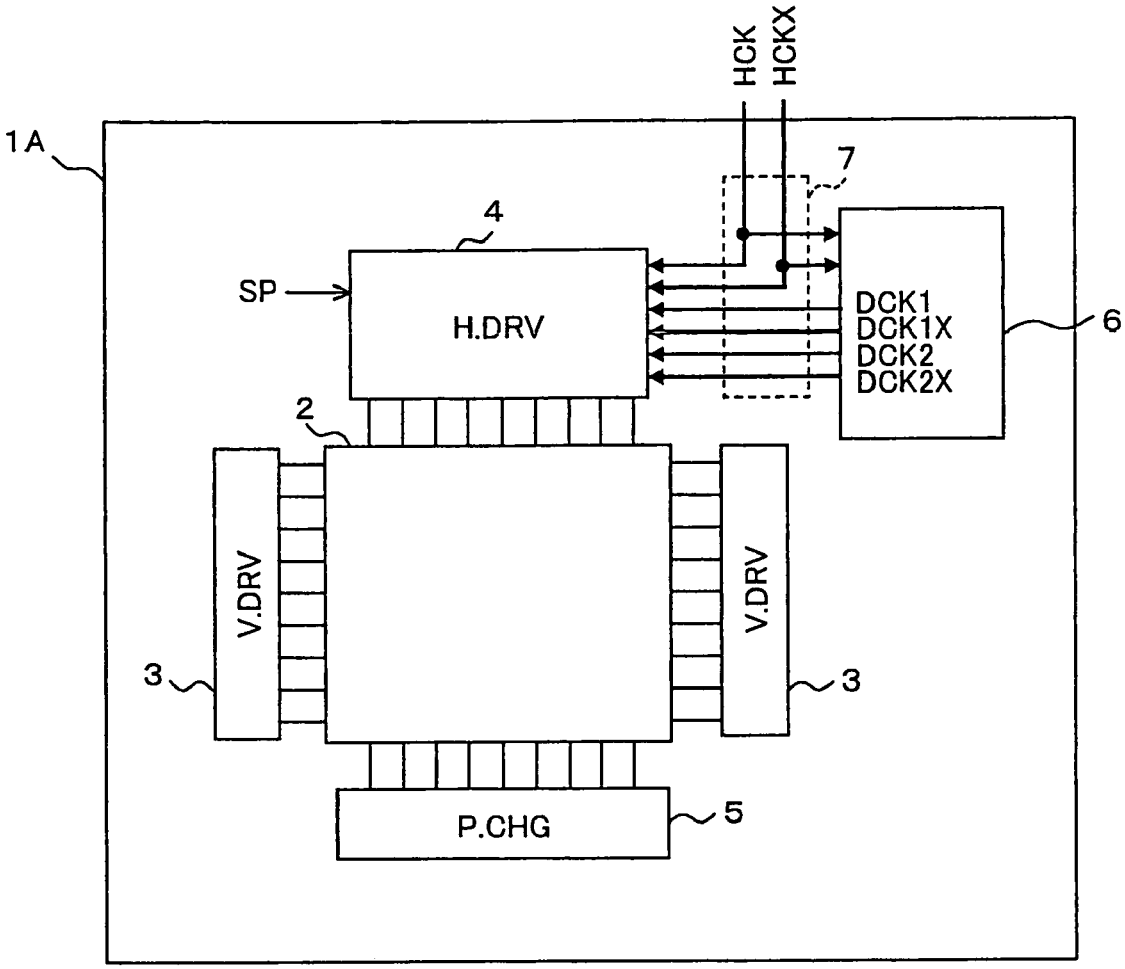
FIG. 1 PRIOR ART
FIG. 1 is a block diagram of the first configuration of a point sequential clock driving system image display panel used in common in an embodiment of the present invention and in the related art.
Figure 2:
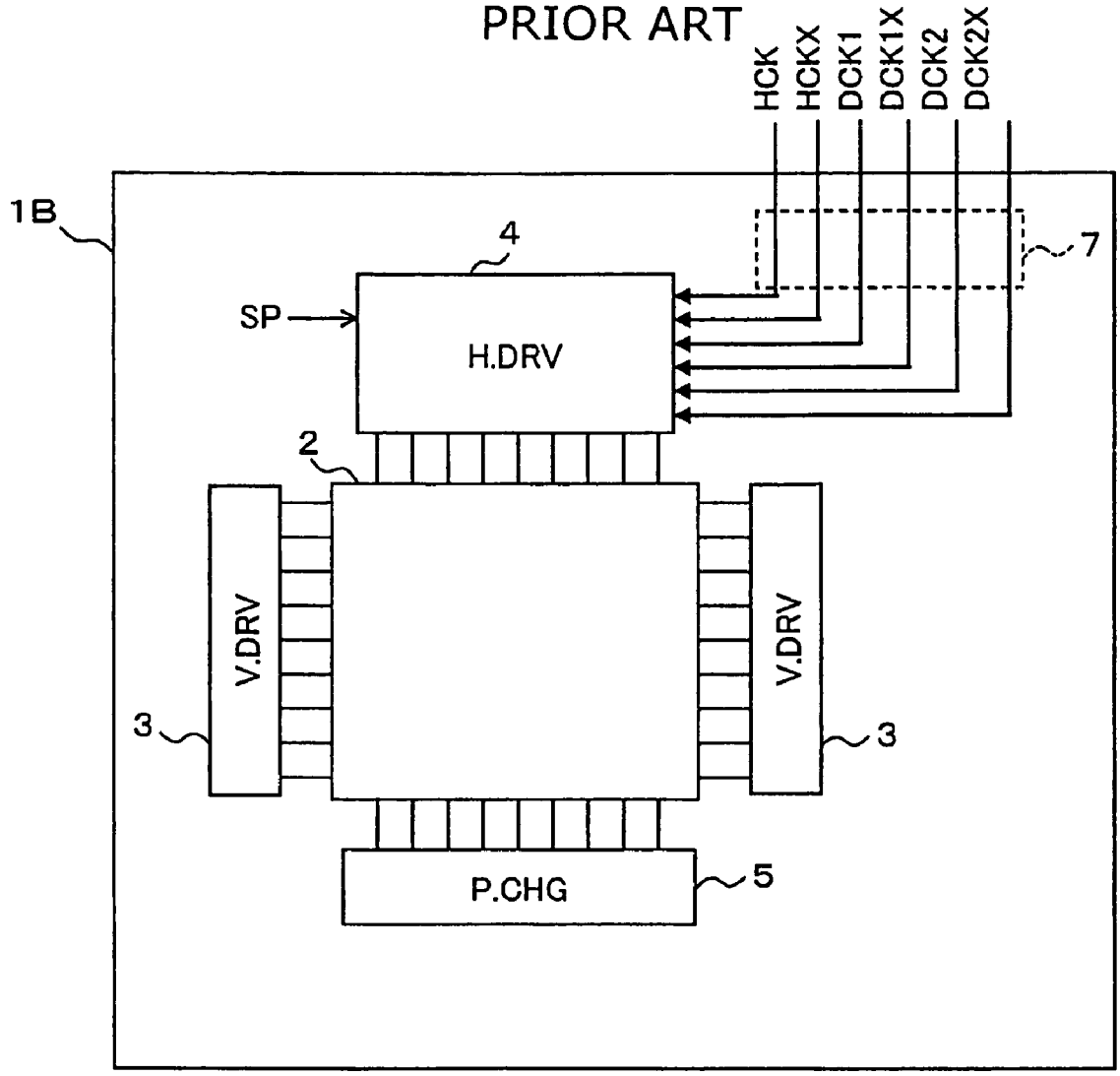
FIG. 2 PRIOR ART
FIG. 2 is a block diagram of the second configuration of a point sequential clock driving system image display panel used in common in an embodiment of the present invention and in the related art.

An overall block diagram of the liquid crystal display panel is shown in common in FIG. 1 and FIG. 2. Note that in the liquid crystal panel 1A shown in FIG. 1, an embodiment of a "clock input circuit" of the present invention is configured by a clock buffer circuit 7 when it exists and by a clock generation portion 6 when the clock buffer circuit 7 does not exist, respectively. Also, in a liquid crystal display panel shown in FIG. 2, when the clock buffer circuit 7 exists, it configures the embodiment of the "clock input circuit" of the present invention.

Figure 4:
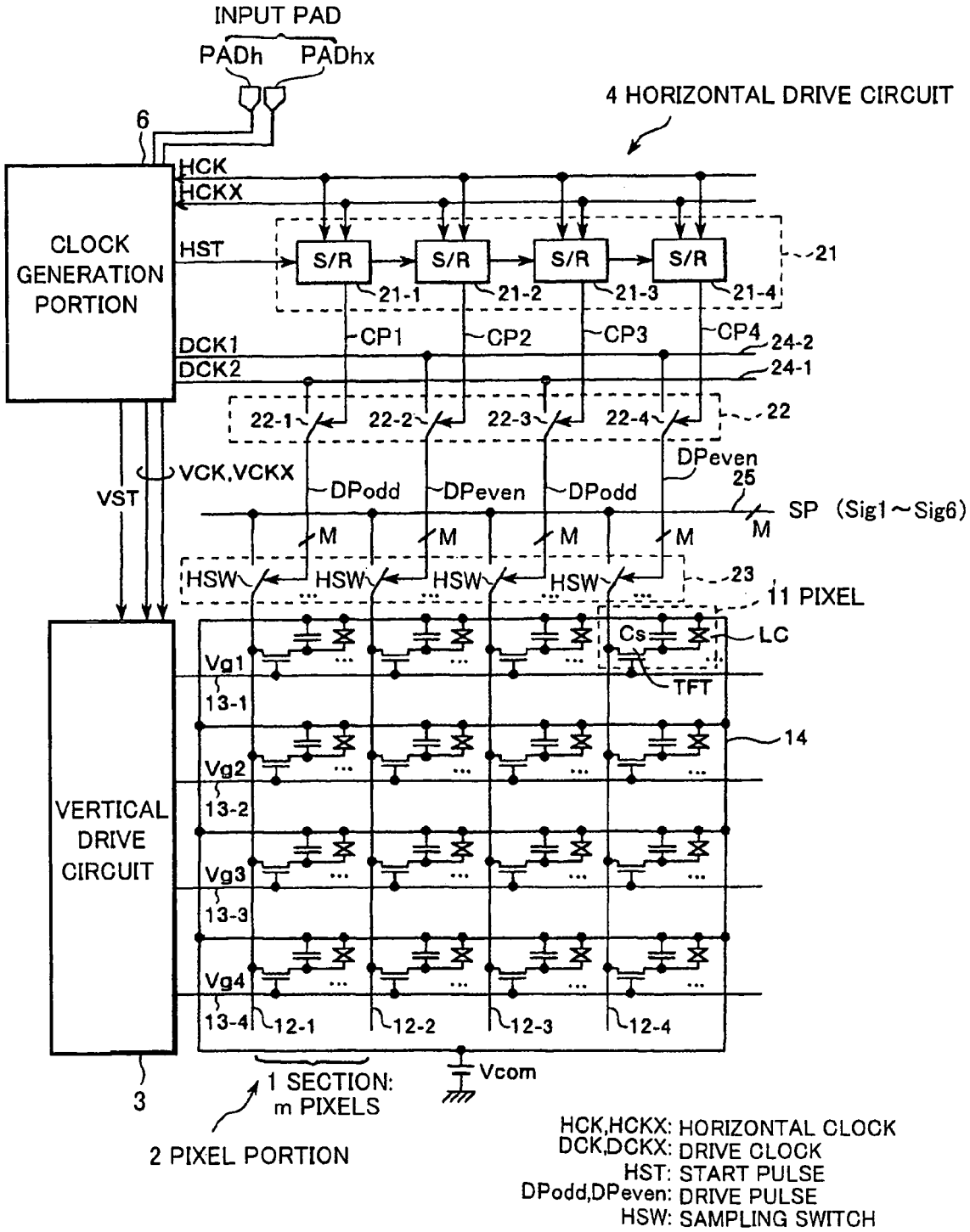
FIG. 4 is a circuit diagram of a point sequential clock driving system liquid crystal display panel in the embodiment of the present invention.
Figure 5:
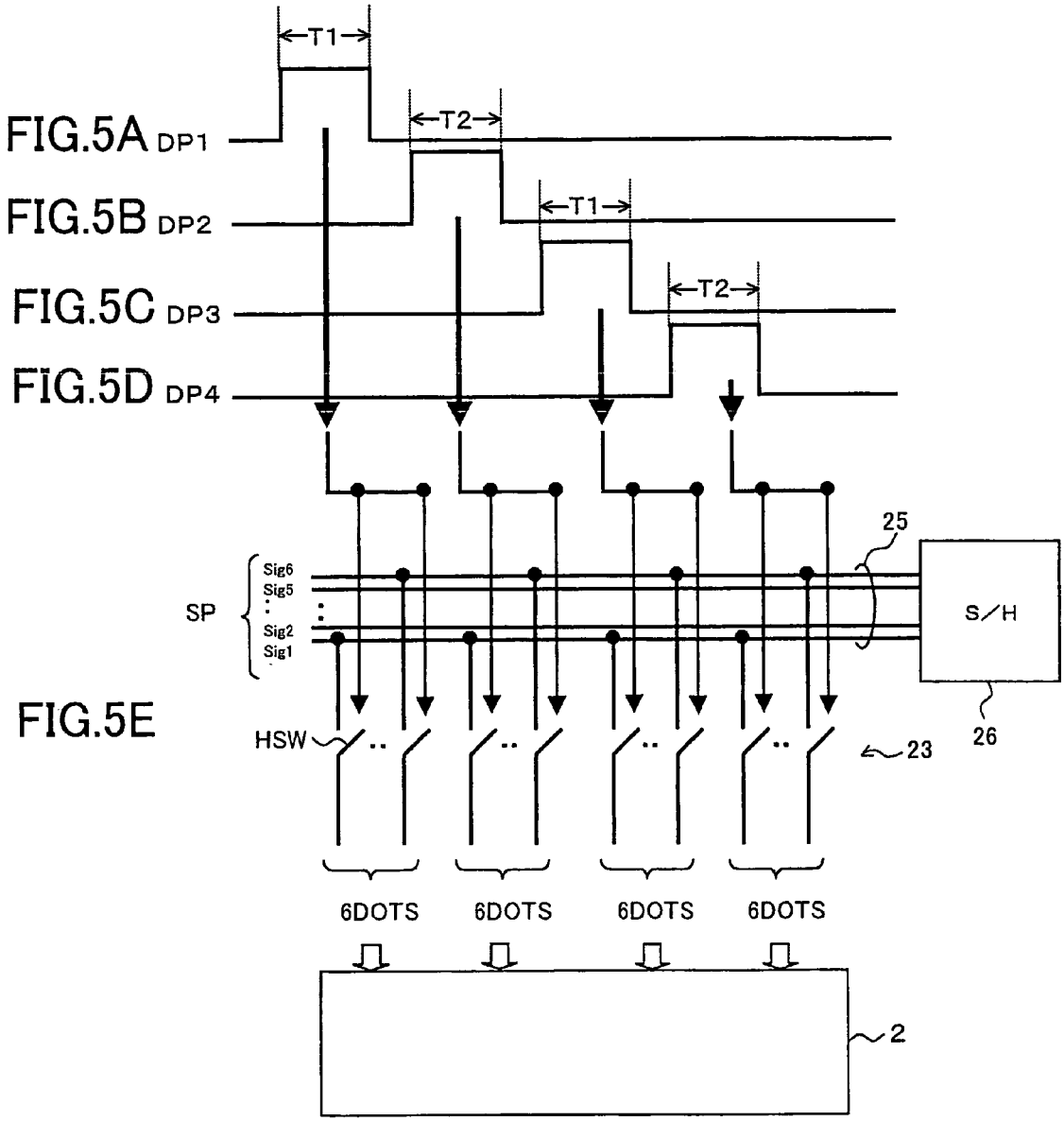
FIG. 5A to FIG. 5D are views of waveforms of a drive pulse in four consecutive sections.
FIG. 5E is a detailed circuit diagram of a part of supplying a video signal.

FIG. 4 is a circuit diagram of a configuration example of a point sequential clock driving system liquid crystal display panel. FIG. 5E is a detailed circuit diagram of a part for supplying a video signal. Also, FIG. 6A to FIG. 6K are timing charts of various clocks and pulses. Note that FIG. 5A to FIG. 5D are also waveforms of four sections of drive pulses similar to FIG. 6A to FIG. 6K.

FIG. 4 shows an example in the case of a pixel arrangement of 4 lines by 4 sections for simplification. Here, a "section" indicates a set of consecutive M-number of pixels in each line to which a video signal is supplied at a time in the M-phase driving method. For example, M=6 in the case of a 6-phase driving XGA panel.

In FIG. 4, each of pixels 11 in 4 lines by 4 sections arranged in matrix comprises a thin film transistor TFT, a liquid crystal cell LC wherein a pixel electrode is connected to one of source and drain of the thin film transistor TFT, and a holding capacitor Cs wherein one electrode is connected to the source or drain. For each of the pixels 11, signal lines (data lines) 12-1 to 12-4 are wired along the pixel arrangement direction for each column, and gate lines 13-1 to 13-4 are wired along the pixel arrangement direction for each row.

In each of the pixels 11, a source (or drain) of the thin film transistor TFT is connected to each of corresponding data lines 12-1 to 12-4, respectively. A gate of the thin film transistor TFT is connected to each of the gate lines 13-1 to 13-4, respectively. A counter electrode of the liquid crystal cell LC and the other electrode of a holding capacitor Cs are connected in common to a Cs line 14 between respective pixels. The Cs line 14 is given a predetermined direct current voltage as a common voltage Vcom.

From the above, the pixel portion 2 is configured by arranging the pixels 11 in matrix, wiring the data lines 12-1 to 12-4 to the pixels in each column, and wiring gate lines 13-1 to 13-4 to the pixels 11 in each row. In the pixel portion 2, one end of each of the gate lines 13-1 to 13-4 are connected to an output terminal of each line of the vertical drive circuit 3.

The vertical drive circuit 3 scans in the vertical direction (column direction) for every field period and successively selects the pixels 11 connected to the gate lines 13-1 to 13-4 in unit of a line. Namely, when a vertical scanning pulse Vg1 is given to the gate line 13-1 from the vertical drive circuit 3, pixels on the first line of respective columns are selected, while when a vertical scanning pulse Vg2 is given to the gate line 13-2, pixels on the second line of respective columns are selected. In the same way, vertical scanning pulses Vg3 and Vg4 are successively given to the gate lines 13-3 and 13-4 after that.

A horizontal drive circuit 4 is arranged on one side in the column direction of the pixel portion 2. Also, a clock generation portion (timing generator) 6 for giving various clock signals to the vertical drive circuit 3 and horizontal drive circuit 4 is provided. The clock generation portion 6 generates a vertical start pulse VST for instructing to start vertical scanning and vertical clocks VCK and VCKX having reversed phases to each other to be a reference of the vertical scanning. Also, the clock generation portion 6 generates a horizontal start pulse HST and horizontal clocks HCK and HCKX having reversed phases to each other to be a reference of the horizontal scanning shown in FIG. 6A to FIG. 6C.

Figure 6:
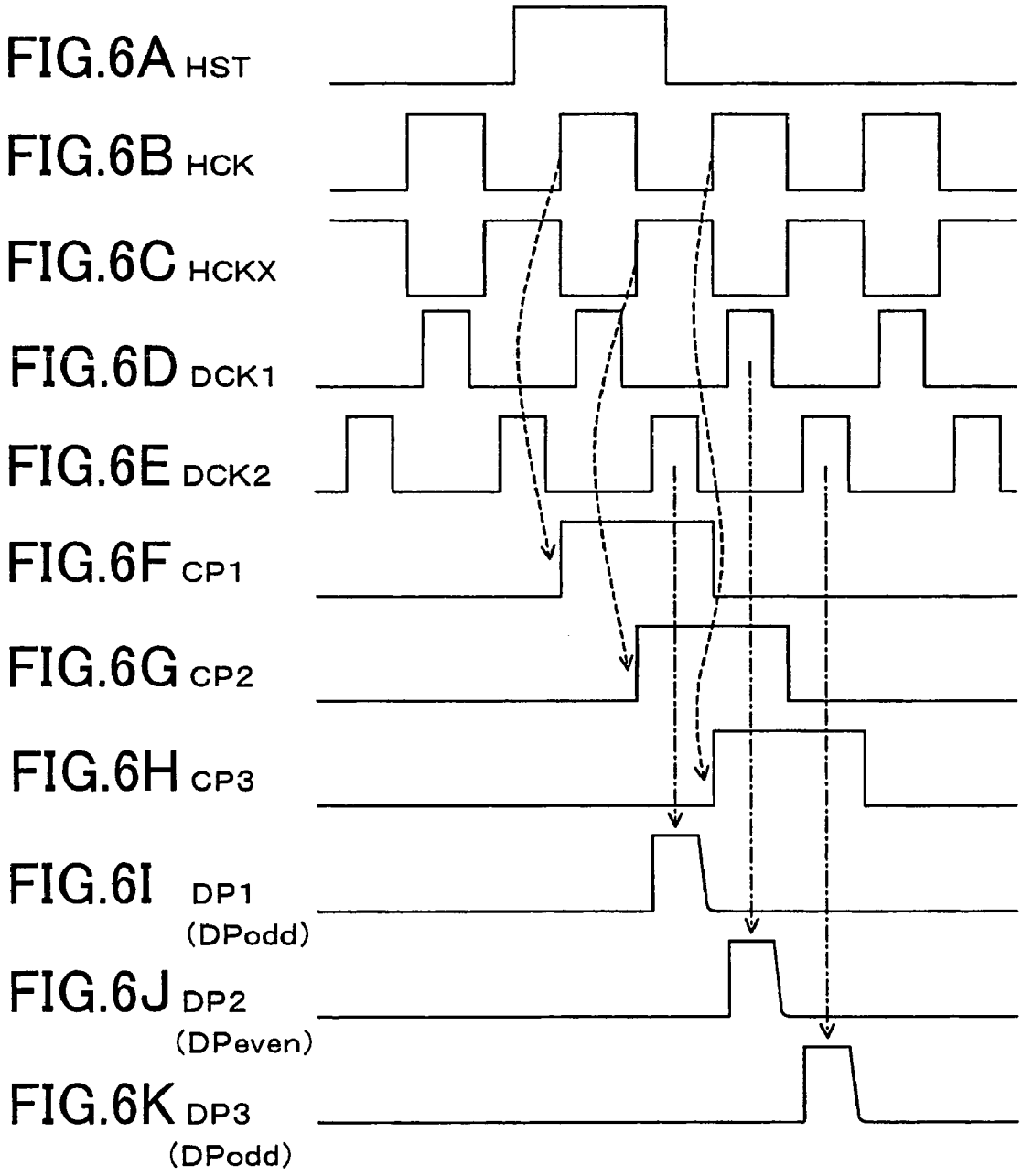
FIG. 6A to FIG. 6K are timing charts of various clocks or pulses.

The clock generation portion 6 further generates drive clocks DCK1 and DCK2 having reversed phases to each other, the same cycle and a smaller duty ratio comparing with the horizontal clocks HCK and HCKX as shown in FIG. 6D and FIG. 6E. Here, the duty ratio is a ratio of a pulse width and a pulse repeating cycle in a pulse waveform.

The horizontal drive circuit 4 is for successively sampling the input video signal SP for every section in 1H (H is a horizontal scan period) and writing data to each pixel 11 selected in unit of a line by the vertical drive circuit 3, wherein a clock drive method is applied in this example and a shift register 21, a clock extraction switch group 22 and a sampling switch group 23 are included.

The shift register 21 comprises four shift register units (S/R) 21-1 to 21-4 corresponding to sections (four sections in this example) of the pixel portion 2 and, when a horizontal start pulse HST is given, performs a shift operation in synchronization with the horizontal clocks HCK and HCKX having reversed phases to each other. As a result, as shown in FIG. 6F to FIG. 6H, clock pulses CP1 to CP4 (CP1 to CP3 are shown in the figure) having the same pulse width with a cycle of the horizontal clocks HCK and HCKX are successively output from the shift register units 21-1 to 21-4 of the shift register 21.

The clock extraction switch group 22 comprises four switches 22-1 to 22-4 corresponding to sections of the pixel portion 2, wherein respective one ends of the switches 22-1 to 22-4 are alternately connected to the clock lines 24-1 and 24-2 for transferring the drive clocks DCK1 and DCK2 from the clock generation portion 6. Namely, one ends of the switches 22-1 and 22-3 are connected to the clock line 24-1 and one ends of the switches 22-2 to 22-4 are connected to the clock line 24-2.

The switches 22-1 to 22-4 of the clock extraction switch group 22 are given clock pulses CP1 to CP4 successively output from the shift register units 21-1 to 21-4 of the shift register 21. Consequently, the switches 22-1 to 22-4 of the clock extraction switch group 22 successively become a turned-on state in response to the input clock pulses CP1 to CP4 and alternately extract pulses from the drive clocks DCK1 and DCK2 having reversed phases to each other. The extracted pulses become drive pulses.

As shown in FIG. 5E, a supply line 25 of the video signal SP is composed of M-number of wirings, 6 here, and one ends of them are connected to a sample holding circuit (S/H) 26 as a video signal drive circuit.

The 6 supply lines 25 of a video signal SP are connected to a data line of the pixel portion 2 by repeating for every section (6 dots). A sampling switch group 23 is configured in the middle of the connection lines of the data line and the supply line 25 of the video signal SP and connected to 4×M number of horizontal data sampling switches HSW corresponding to pixel columns of the pixel portion 2. Control terminals of the horizontal data sampling switches HSW are given the drive pulses extracted by the switches 22-1 to 22-4 of the clock extraction switch group 22. Here, data sampling pulses in odd sections are indicated as DPodd or DP1, DP3, . . . and data sampling pulses in even sections are indicated as DPeven or DP2, DP4 . . . .

As shown in FIG. 5E, the wiring configuration is made that the drive pulses are applied to the six horizontal data sampling switches HSW all at once for each section. Therefore, six video data Sig1 to Sig6 obtained by dividing a video signal SP to six wiring 25 are sampled at a time by the sample holding circuit 26 and supplied to corresponding sections (6 dots) of the pixel portion 2 at a time.

In the horizontal drive circuit 4 according to the present embodiment configured as above, the clock pulses CP1 to CP4 successively output from the shift register 21 are not used as sample pulses, but pulses (drive pulses) DP1 to DP4 obtained by alternately extracting pulses from the drive clocks DCK2 and DCK1 having reversed phases to each other and small duty ratio are used as sampling pulses of horizontal data. As a result, overlapping of sampling pulses is prevented and a necessary ghost margin is secured.

Figure 7:
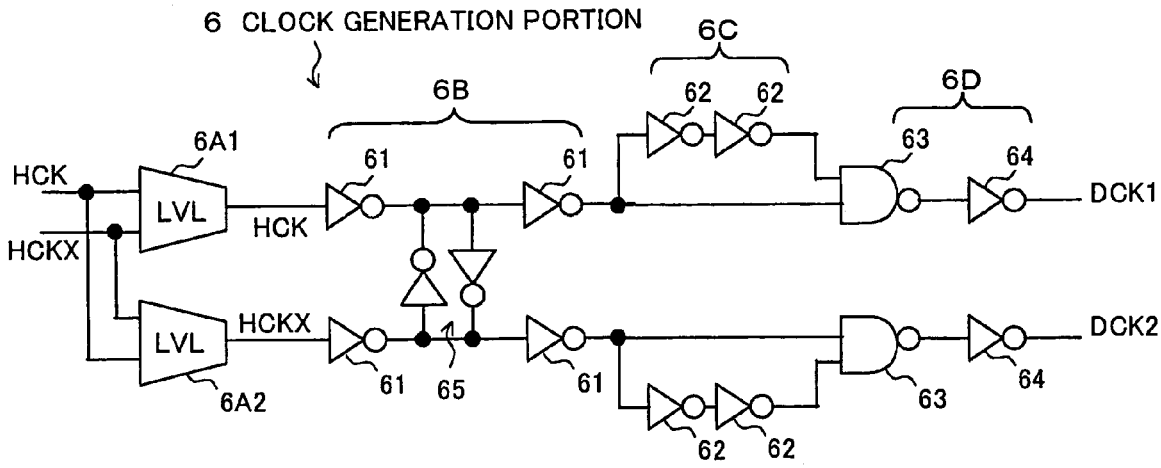
FIG. 7 is a circuit diagram of a clock generation circuit.
Figure 8:
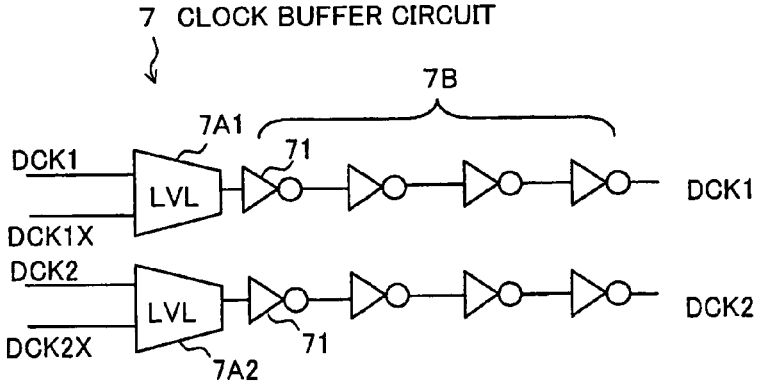
FIG. 8 is a circuit diagram of a clock buffer circuit.

FIG. 7 is a view of an example of a circuit configuration of the clock generation portion, and FIG. 8 is an example of the configuration of the clock buffer circuit.

The clock generation portion 6 shown in FIG. 7 is a circuit for receiving as an input horizontal clocks HCK and HCKX from input pads PADh and PADhx (refer to FIG. 4) of the panel and generating drive clocks DCK1 and DCK2 based thereon.

In the clock generation circuit 6, when roughly divided, each of a generation system of the drive clock DCK1 and a generation system of the drive clock DCK2 comprises a level shifter (LVL) 6A1 (or 6A2), an input buffer portion 6B, a delay portion 6C for changing the duty ratio and an output buffer portion 6D.

The level shifter 6A is a circuit for converting a voltage level of the input horizontal clocks HCK and HCKX, for example, 0V to 3V or 0V to 5V to a voltage level of panel driving, for example, 0V (or less than 0V and more than −1V) to 15V or so. The level shifter 6A1 on the drive clock DCK1 system side outputs a horizontal clock HCK after the level conversion. Also, the level shifter 6A2 on the drive clock DCK2 system side outputs an inverted horizontal clock HCKX after the level conversion. Therefore, clock signals passing through stages after the level shifter have reversed phases to each other.

The input buffer portion 6B comprises even number of inverters 61 in each system of the drive clocks DCK1 and DCK2.

The delay portion 6C comprises delay elements, for example, inverters 62 by a quantity required for obtaining a delay amount corresponding to a desired duty ratio in each system of the drive clocks DCK1 and DCK2. When the delay element is an inverter, the quantity becomes even.

The output buffer portion 6D comprises two input NAND gates 63 and the odd number of inverters 64 in each system of the drive clocks DCK1 and DCK2. One input of the NAND gate 63 receives as an input a delayed horizontal clock HCK or HCKX, and the other input receives as an input a horizontal clock HCK or HCKX before being delayed. In accordance with a delay amount, the NAND gate 63 outputs a pulse having a larger duty ratio than that of the original horizontal clock and, by inverting the same, a drive clock DCK1 or DCK2 having a pulse width of smaller than that of the original horizontal clock is generated.

Note that, in the clock generation portion 6 in the illustrated example, synchronization is attained by providing a latch circuit 65 between the systems of the drive clocks DCK1 and DCK2. The latch circuit 65 is provided to an input buffer portion 6B in FIG. 7, but it may be provided to other places, such as an output buffer portion 6D.

The clock buffer circuit 7 shown in FIG. 8 is a circuit mainly for performing level shift, which may be provided separately from the horizontal drive circuit (H.DRV) 4 as shown in FIG. 2 or it may be provided to a clock input portion in the horizontal drive circuit 4.

The clock buffer circuit 7 comprises a level shifter 7A1 (or 7A2) and an output buffer portion 7B in each of the system for generating the drive clock DCK1 and the system for generating the drive clock DCK2. The level shifter 7A1 and 7A2 have a similar function as that of the level shifter shown in FIG. 7. The output buffer portion 7B comprises an even number of inverters 71 in each system. The inverter at the final stage outputs a drive clock DCK1 or DCK2 after the level conversion.

The clock generation portion 6 and the clock buffer circuit 7 explained above respectively have identical two level shifters for correcting the duty ratio, that is, 6A1 and 6A2 (or 7A1 and 7A2) and generates from two input clocks having reversed phases from each other a drive clock DCK2 having a narrow pulse to be a sampling pulse in odd sections and a drive clock DCK1 having a narrow pulse to be a sampling pulse in even sections. Inside these circuits, by being suitably provided with a latch circuit and having an identical circuit in each of the systems to be a symmetrical layout, deviation of duty between the odd sections and even sections, that is, a difference of widths of the narrow pulses (sampling pulses) is suppressed to a level of not causing any problems.

In the present embodiment, in addition to the prevention of the duty deviation inside the clock generation portion 6 and the clock buffer circuit 7, duty deviation in wiring from the input pad of the clock to the circuit is prevented.

Figure 9:
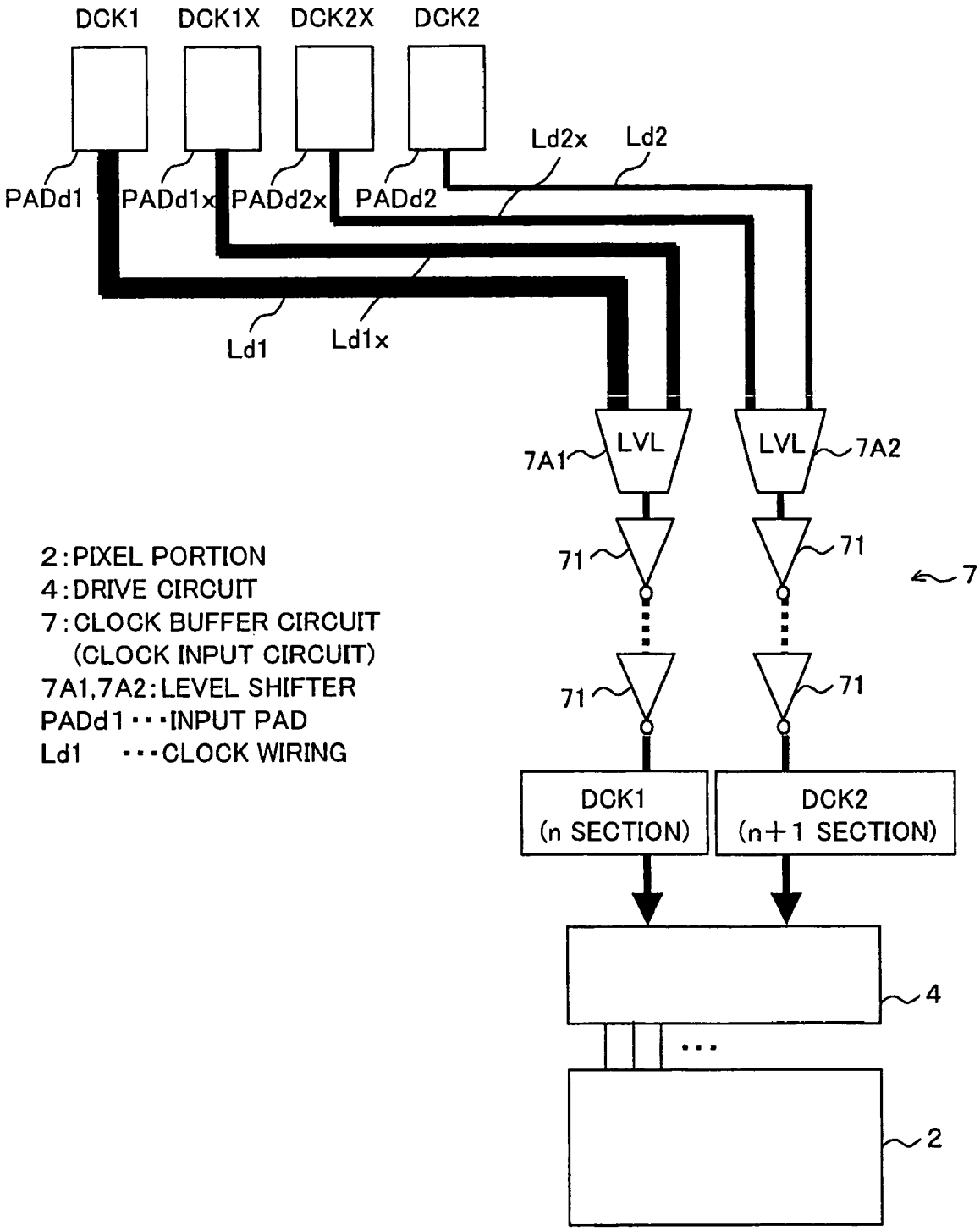
FIG. 9 is a view of wiring of a drive clock from input pads to the clock buffer circuit of the panel.

FIG. 9 is a view of wiring drive clocks DCK1, DCK1X, DCK2 and DCK2X input to the clock buffer circuit 7. Also, in FIG. 10, wiring of drive clocks in a panel of the related art is shown as a comparative example.

Figure 10:
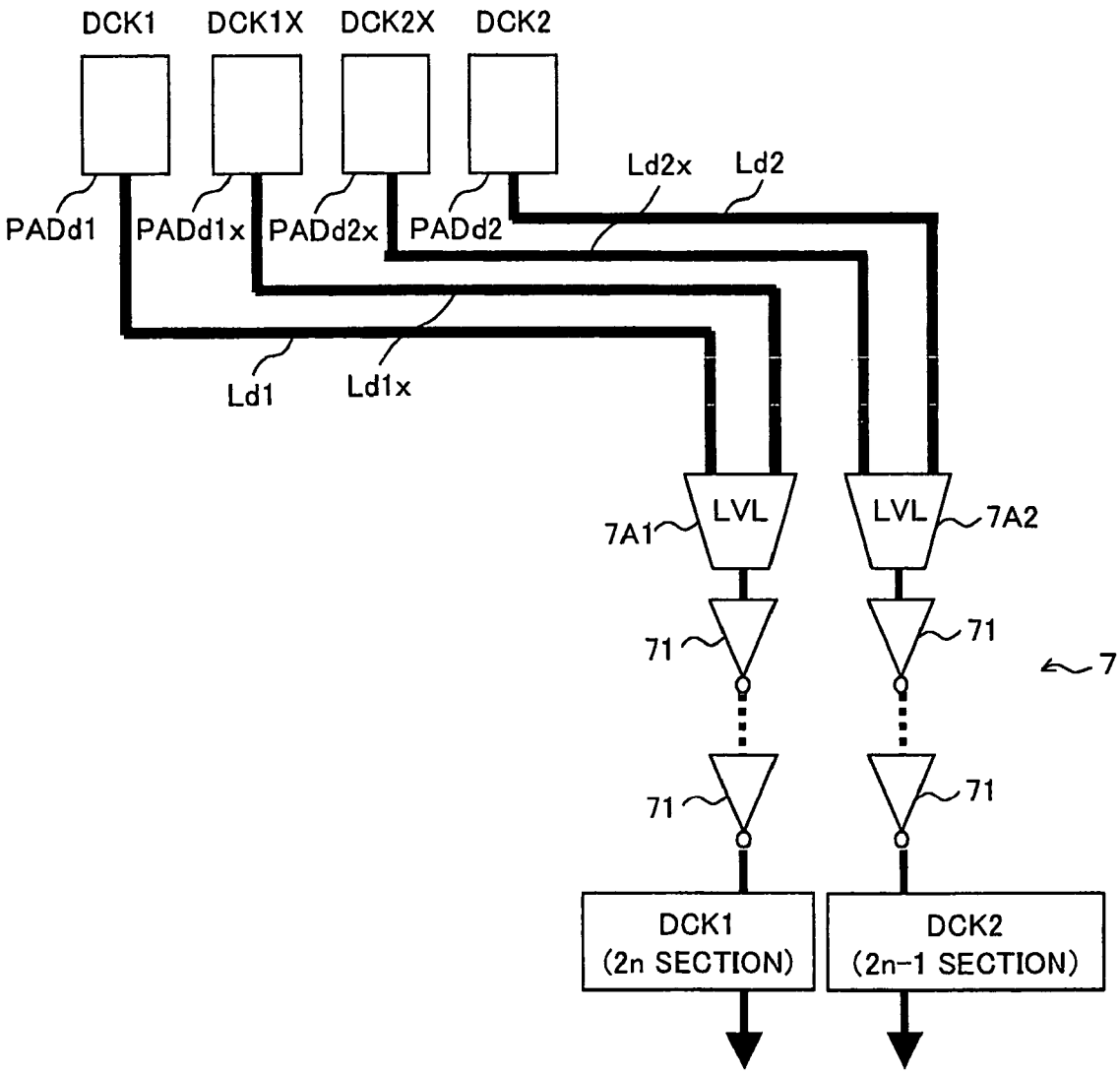
FIG. 10 is a view of wiring of a drive clock from input pads to a clock buffer circuit in a panel of the related art as a comparative example.

Generally, since clock channel of a LCD panel has resistance and a parasitic capacitance, rising and falling of each input clock is out of shape inside the LCD panel. Therefore, when wiring Ld1 from an input pad PADd1 of a drive clock DCK1 to a level shifter (LVL) 7A1, wiring Ld1*x* from an input pad PADd1*x* of a drive clock DCK1X to a level shifter 7A1, wiring Ld2 from an input pad PADd2 of a drive clock DCK2 to a level shifter 7A2, and wiring Ld2*x* from an input pad PADd2*x* of a drive clock DCK2X to a level shifter 7A2 are laid out by leaving same widths as shown in FIG. 10, a pulse width of each clock becomes wider by 2 nsec or so in some cases because a pulse having high input wiring resistance up to immediately before a level shifter rises or falls slower comparing with a pulse having a low input wiring resistance. Pulses having different duties immediately before the level shifter are input as they are as drive clocks DCK1 and DCK2 after level conversion to a horizontal drive circuit 4 shown in FIG. 4 via level shifters 7A1 and 7A2 and an inverter 71.

In the horizontal drive circuit 4, pulses are extracted while maintaining the duty difference of 2 nsec or so arisen at first on the input pad side, and pulse widths of the thus obtained drive pulses DP become different by 2 nsec or so between an even section and an odd section.

Figure 11C:
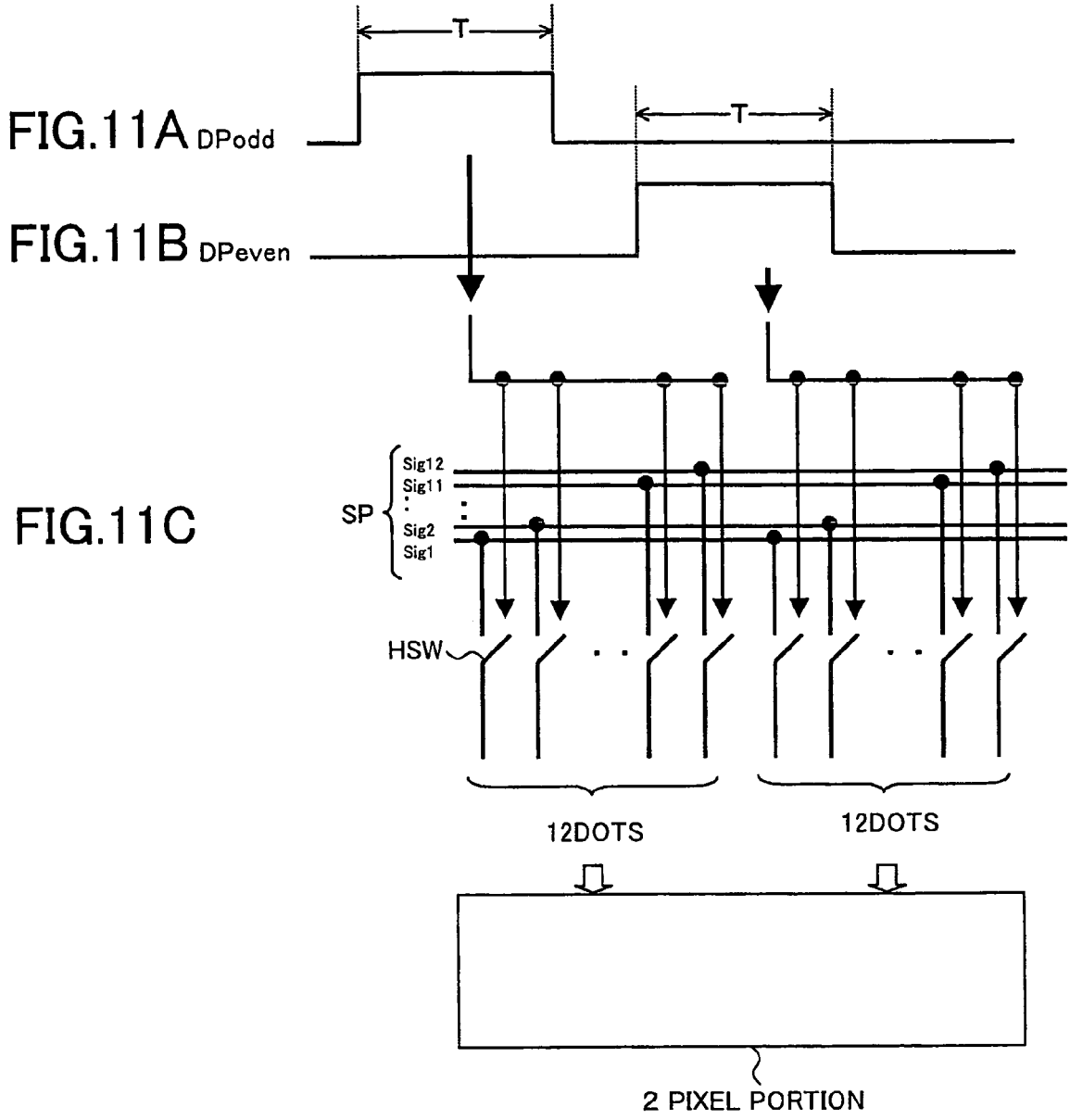
FIG. 11C is a circuit diagram of a part of supplying the video signal.

For example, in a 12-phase drive XGA panel shown in FIG. 11C, a width T of drive pulses DPodd and DPeven is relatively long as 150 nsec as shown in FIG. 11A and FIG. 11B. Thus, the pulse width does not cause a much difference in a sample holding potential VH by the duty difference of 2 nsec or so, a margin voltage of a uniformity improve signal PsigG for prevention of stripes (broad lines) is large as 1.0V or so, and a stripe pattern in a sampling cycle (6 dots) does not appear on the display screen.

However, when using a narrow width pulse having a width of 30 to 45 nsec or so as in a 6-phase drive XGA panel, the duty difference of 2 nsec or so notably, appears as a difference of a holding potential VH due to the narrow pulse width. Therefore, the margin voltage of the uniformity improve signal PsigG is reduced to 0.2V or so and a stripe pattern in a sampling cycle is liable to arise on the display screen.

Here, the uniformity improve signal PsigG is a signal for adjusting a difference of an arrival holding voltage between an odd section and an even section by adjusting the potential to be an optimal value. When a margin voltage of the signal PsigG is small, a stripe pattern is liable to appear, while when it is large, a stripe pattern hardly arises but the margin voltage becomes smaller in narrow pulse driving as explained above.

In the present embodiment, as shown in FIG. 9, resistance of the input wirings Ld1, Ld1*x*, Ld2 and Ld2*x* from input pads of drive clocks DCK1, DCK1X, DCK2 and DCK2X are made same between clocks, so that input wiring resistance is made approximately the same. For example, in the case of forming these drive clock wirings by forming a conductive layer of a same stack level at a time, when sheet resistance thereof is the same, the width and the length are optimized and resistance of each wiring is made approximately the same as that of four drive clocks. When using conductive layers having different sheet resistance, a width and length of each wiring are adjusted in consideration of that to make the resistance the same.

As a result, the drive clocks DCK1, DCK1X, DCK2 and DCK2X input to the level shifter become clocks having the same duty ratio. Accordingly, as shown in FIG. 12A to FIG. 12C, drive pulses DP generated by extracting pulses from them become pulses having no duty difference between an odd section and an even section, that is, pulses having the same widths (T1=T2). Therefore, as shown in FIG. 12D, a holding potential difference ΔVH due to a duty difference of a sampling pulse width does not arise or becomes as small as it can be ignored. Also, a margin voltage of the uniformity improve signal PsigG becomes large.

As a result of the above, on a screen displayed by horizontal scanning using a narrow sampling pulse of 30 to 45 nsec or so, such as a 6-phase drive XGA panel, a stripe pattern in the sampling cycle does not arise as shown in FIG. 12E.

Note that, in the above explanation, resistance of input wiring from the input pads of drive clock DCK1, etc. input to the screen display panel from the outside to the level shifter was unified, but it is more preferable to unify input wiring resistance of horizontal clocks HCK and HCKX in the same way. The horizontal clocks HCK and HCKX do not regulate a sampling pulse width and relates to a sampling timing, and accuracy of a sampling operation can be improved by unifying the input wiring resistance.

Also, in the case where the level shifter is provided to an input stage of the horizontal drive circuit 4, resistance (and parasitic capacities) of clocks from the clock input pad to the horizontal drive circuit 4 can be unified between clocks.

In an image display device, when a necessary clock is given to a panel from the outside, it is more preferable if wiring resistance from a circuit outside the panel for generating a clock, for example, formed on a circuit substrate inside the image display device body to an input pad of the panel is unified between clocks in addition to unifying the wiring resistance inside the panel as explained above. This is required because a stripe pattern cannot be completely prevented unless a duty difference of clocks is suppressed on portions other than the panel particularly when generating a drive clock outside the panel.

Furthermore, particularly in the case where the duty difference cannot be completely prevented only by unifying the wiring resistance in wiring of clocks having a high frequency, wiring may be designed in consideration of a material of wiring and an insulation layer around it, a wiring area and a parasitic capacitance due to a difference of a potential relationship, etc. with a conductive layer around.

The above explanation was made on the case of applying to a liquid crystal display device installed with an analog interface drive circuit for driving respective pixels point sequentially by receiving an analog video signal and sampling the same, but the present invention can be applied to a liquid crystal display device installed with a digital interface drive circuit for driving respective pixels point sequentially by receiving a digital video signal, converting it to an analog video signal and sampling the analog video signal in the same way.

Also, in the above explanation, the case of applying to an active matrix type liquid crystal display device using a liquid crystal cell for a pixel was taken as an example, but the present invention is not limited to be applied to a liquid crystal display device but to those using, for example, an electro luminescence (EL) element as a display element of a pixel.

Note that as other point sequential driving systems, to which the present invention can be applied, other than the well known 1H inversion driving system and the dot inversion driving system, there is a so-called dot-line inversion driving system for writing video signals of reversed polarities to each other at a time on adjacent two lines away by odd lines on pixel columns, for example, on two lines of pixels above and below, so that polarities of pixels become the same in adjacent pixels right and left and reversed in pixels above and below in a pixel arrangement after wiring a video signal.

Also, an image display panel may be a projection type liquid crystal panel (an image display panel inside a liquid crystal projector) provided for each of RGB other than the direct-view-type.

According to the present invention, a vertical stripe pattern on the display screen of an image display device and an image display panel of narrow pulse driving can be prevented.

The embodiments explained above are for easier understanding of the present invention and not to limit the present invention. Accordingly, respective elements disclosed in the above embodiments includes all modifications in designs and equivalents belonging to the technical field of the present invention.

What is claimed is:

1. An image display panel, comprising a pixel portion arranged with pixels in matrix;

a drive circuit connected to each data line shared by said pixels in each column of said pixel portion for controlling supplying of a video signal to be input to the data line based on a plurality of clocks to be input;

a plurality of input pads for inputting said plurality of clocks; and a clock input circuit connected between said input pads and said drive circuit, wherein lengths of wirings from said plurality of input pads to said clock input circuit are different from each other and the shorter wiring is thinner than the longer wiring.

2. An image display panel as set forth in claim 1, wherein said drive circuit includes a video signal drive circuit for dividing a video signal to M number (two or more), holding temporarily, and outputting at a time at a point when video signal data for an amount of M-number of pixels is prepared, and supplies said video signal data for an amount of M-number of pixels output from said video signal drive circuit to M-number of said data lines at a time.

3. An image display panel, comprising:

a pixel portion arranged with pixels in matrix;

a drive circuit connected to each data line shared by said pixels in each column of said pixel portion for controlling supplying of a video signal to be input to the data line; and a plurality of input pads for inputting a plurality of clocks for driving said drive circuit, wherein lengths of wirings from said plurality of input pads to said drive circuit are different from each other and the shorter wiring is thinner than the longer wiring.

4. An image display panel as set forth in claim 3, wherein said drive circuit includes a video signal drive circuit for dividing a video signal to M number (two or more), holding temporarily, and outputting at a time at a point when video signal data for an amount of M-number of pixels is prepared, and supplies said video signal data for an amount of M-number of pixels output from said video signal drive circuit to M-number of said data lines at a time.

5. An image display device, comprising:

an image display panel having a pixel portion arranged with pixels in matrix, a drive circuit connected to each data line shared by said pixels in each column of said pixel portion for controlling supplying of a video signal to be input to the data line, and a clock input circuit for receiving as an input a plurality of clocks for driving said drive circuit and outputting to said drive circuit; and a clock generation circuit for generating said plurality of clocks, wherein lengths of wirings from the outputs of said clock generation circuit outside said image display panel to said clock input circuit inside said image display panel are different from each other and the shorter wiring is thinner than the longer wiring.

6. An image display device as set forth in claim 5, wherein said drive circuit includes a video signal drive circuit for dividing a video signal to M number (two or more), holding temporarily, and outputting at a time at a point when video signal data for an amount of M-number of pixels is prepared, and supplies said video signal data for an amount of M-number of pixels output from said video signal drive circuit to M-number of said data lines at a time.

7. An image display device, comprising:

an image display panel having a pixel portion arranged with pixels in matrix, a drive circuit connected to each data line shared by said pixels in each column of said pixel portion for controlling supplying of a video signal to be input to the data line; and a clock generation circuit for generating said plurality of clocks, wherein lengths of wirings from the outputs of said clock generation circuit outside said image display panel to said drive circuit inside said image display panel are different from each other and the shorter wiring is thinner than the longer wiring.

8. An image display device as set forth in claim 7, wherein said drive circuit includes a video signal drive circuit for dividing a video signal to M number (two or more), holding temporarily, and outputting at a time at a point when video signal data for an amount of M-number of pixels is prepared, and supplies said video signal data for an amount of M-number of pixels output from said video signal drive circuit to M-number of said data lines at a time.

9. An image display panel, comprising a pixel portion arranged with pixels in matrix;

a drive circuit connected to each data line shared by said pixels in each column of said pixel portion for controlling supplying of a video signal to be input to the data line based on a plurality of clocks to be input;

a plurality of input pads for inputting said plurality of clocks;

a clock input circuit connected between said input pads and said drive circuit; and means for adjusting the resistance of wirings from said plurality of input pads to said clock input circuit to be approximately the same between a plurality of clocks while the respective lengths of said wirings are different.

10. An image display panel as set forth in claim 9, wherein said drive circuit includes a video signal drive circuit for dividing a video signal to M number (two or more), holding temporarily, and outputting at a time at a point when video signal data for an amount of M-number of pixels is prepared, and supplies said video signal data for an amount of M-number of pixels output from said video signal drive circuit to M-number of said data lines at a time.

11. An image display panel, comprising:

a pixel portion arranged with pixels in matrix;

a drive circuit connected to each data line shared by said pixels in each column of said pixel portion for controlling supplying of a video signal to be input to the data line;

a plurality of input pads for inputting a plurality of clocks for driving said drive circuit; and means for adjusting the resistance of wirings from said plurality of input pads to said drive circuit to be approximately the same between a plurality of clocks while the respective lengths of said wirings are different.

12. An image display panel as set forth in claim 11, wherein said drive circuit includes a video signal drive circuit for dividing a video signal to M number (two or more), holding temporarily, and outputting at a time at a point when video signal data for an amount of M-number of pixels is prepared, and supplies said video signal data for an amount of M-number of pixels output from said video signal drive circuit to M-number of said data lines at a time.

13. An image display device, comprising:

an image display panel having a pixel portion arranged with pixels in matrix, a drive circuit connected to each data line shared by said pixels in each column of said pixel portion for controlling supplying of a video signal to be input to the data line, and a clock input circuit for receiving as an input a plurality of clocks for driving said drive circuit and outputting to said drive circuit;

a clock generation circuit for generating said plurality of clocks; and means for adjusting the resistance of wirings from an output of said clock generation circuit outside said image display panel to said clock input circuit inside said image display panel to be approximately the same between a plurality of clocks while the respective lengths of said wirings are different.

14. An image display device as set forth in claim 13, wherein said drive circuit includes a video signal drive circuit for dividing a video signal to M number (two or more), holding temporarily, and outputting at a time at a point when video signal data for an amount of M-number of pixels is prepared, and supplies said video signal data for an amount of M-number of pixels output from said video signal drive circuit to M-number of said data lines at a time.

15. An image display device, comprising:

an image display panel having a pixel portion arranged with pixels in matrix, a drive circuit connected to each data line shared by said pixels in each column of said pixel portion for controlling supplying of a video signal to be input to the data line;

a clock generation circuit for generating said plurality of clocks; and means for adjusting the resistance of wirings from an output of said clock generation circuit outside said image display panel to said drive circuit inside said image display panel to be approximately the same between a plurality of clocks while the respective lengths of said wirings are different.

16. An image display device as set forth in claim 15, wherein said drive circuit includes a video signal drive circuit for dividing a video signal to M number (two or more), holding temporarily, and outputting at a time at a point when video signal data for an amount of M-number of pixels is prepared, and supplies said video signal data for an amount of M-number of pixels output from said video signal drive circuit to M-number of said data lines at a time.

17. An image display panel, comprising a pixel portion arranged with pixels in matrix;

a drive circuit connected to each data line shared by said pixels in each column of said pixel portion for controlling supplying of a video signal to be input to the data line based on a plurality of clocks to be input;

a plurality of input pads for inputting said plurality of clocks; and a clock input circuit connected between said input pads and said drive circuit, wherein lengths of wirings from said plurality of input pads to said clock input circuit are different from each other and the respective widths of said wirings are directly proportional to their respective lengths.

18. An image display panel, comprising a pixel portion arranged with pixels in matrix;

a drive circuit connected to each data line shared by said pixels, a clock input circuit being connected to said drive circuit;

a plurality of input pads adapted to receive a plurality of clocks, wherein wirings connect said plurality of input pads to said clock input circuit, resistance of each said wirings between said plurality of input pads and said clock input circuit being approximately the same.

19. An image display device as set forth in claim 18, wherein said drive circuit controls supply of a video signal to be input to said data line based on said plurality of clocks.

* * * * *